US006481461B1

(12) United States Patent
Habermann et al.

(10) Patent No.: US 6,481,461 B1
(45) Date of Patent: Nov. 19, 2002

(54) HYDRAULIC PILOT CONTROL

(75) Inventors: Heinz Habermann, Lohr/Main (DE); Wilhelm Kastel, Rellingen (DE)

(73) Assignee: Bosch Rexroth AG, Lohr/Main (DE)

( * ) Notice: Subject to any disclaimer, the term of this patent is extended or adjusted under 35 U.S.C. 154(b) by 0 days.

(21) Appl. No.: 09/937,323

(22) PCT Filed: Mar. 2, 2000

(86) PCT No.: PCT/EP00/01790

§ 371 (c)(1),
(2), (4) Date: Sep. 20, 2001

(87) PCT Pub. No.: WO00/57067

PCT Pub. Date: Sep. 28, 2000

(30) Foreign Application Priority Data

Mar. 24, 1999 (DE) ..... 199 13 276

(51) Int. Cl.[7] ..... F15B 13/02
(52) U.S. Cl. ..... 137/596; 60/436; 137/625.23
(58) Field of Search ..... 60/436; 137/596, 137/625.23

(56) References Cited

U.S. PATENT DOCUMENTS 2,523,532 A 9/1950 Harnick
3,150,685 A * 9/1964 Lohbauer et al. ..... 137/596.13
3,605,806 A * 9/1971 Coatti ..... 137/596.13
3,847,180 A * 11/1974 Kroth et al. ..... 137/596.13
4,436,020 A * 3/1984 Budzich ..... 137/596
5,984,277 A * 11/1999 Kanzler et al. ..... 60/436

FOREIGN PATENT DOCUMENTS

| | | |
|---|---|---|
| DE | 1601720 | 1/1971 |
| DE | 116080 | 11/1975 |
| DE | 4316229 | 11/1994 |
| DE | 19630798 | 1/1998 |

* cited by examiner

*Primary Examiner*—Gerald A. Michalsky
(74) *Attorney, Agent, or Firm*—Martin A. Farber

(57) ABSTRACT

A hydraulic pilot control system having two control outputs to which a control pressure can be applied and having a hydraulic pilot controller, which has a handle which can be pivoted from a neutral position in a first direction and in a second direction, and a pressure valve that can be displaced from the neutral position by the deflection of the handle. During pivoting of the handle in the first direction and during pivoting of the handle in the second direction, the pressure valve can be adjusted with the same effect, and wherein there is a directional control valve which, depending on the pivoting direction of the handle, connects a control output of the pressure valve to the first control output or to the second control output, whereby a behavior of the pilot control pressure which is symmetrical with respect to the deflection of the control lever in the two directions is adjustable in a simple way.

15 Claims, 6 Drawing Sheets

HYDRAULIC PILOT CONTROL

FIELD AND BACKGROUND OF THE INVENTION

The invention is based on a hydraulic pilot control system having two control outputs (96, 97) to which a control pressure can be applied and having a hydraulic pilot controller, which has a handle (81) which can be pivoted from a neutral position in a first direction to apply a variable control pressure to the first control output (96) and in a second direction, which is preferably opposite to the first direction, to apply a variable control pressure to the second control output (97), and a pressure valve (69) which can be displaced from the neutral position by the deflection of the handle (81) and generates a control pressure at a control output (80).

Such a hydraulic pilot control system is disclosed, for example, by DE 196 30 798 A1. This pilot control system comprises a pilot controller which contains a plurality of pressure reducing valves, by which a pilot control pressure can be generated by each at a control output. The pilot controller has a control lever which, from a neutral position, can be pivoted in a first direction to adjust a first pressure reducing valve and in a second direction, opposed to the first direction, to adjust a second pressure reducing valve. In general, after the control lever has been pivoted through a specific angle in the first direction, the pilot control pressure then present on the first control output is different from the pilot control pressure present on the second control output when the control lever is deflected by the same angle in the second direction. This can be attributed to the tolerances with which the individual components of a pressure reducing valve are afflicted. In particular, the tolerances of the control spring of a pressure valve influence the pilot control pressure.

The difference in the pilot control pressures at a specific pivoting angle of the control lever is not desirable in certain cases. In addition, there are applications in which, irrespective of the pivoting direction, the intention is for the same pressure to be present either on the first control output or on the second control output after a specific pivoting angle of the control lever. For example, a hydraulic control arrangement for a winch is known in which pivoting the control lever from its neutral position firstly adjusts a proportionally adjustable directional control valve from its mid-position in one direction or in the other direction, depending on the pivoting direction of the control lever. Beginning at a specific pivoting angle of the control lever, the feed diaphragm of the directional control valve is completely open. Starting at this pivoting angle, irrespective of the pivoting direction of the control lever, the absorption volume of a hydraulic motor driving the winch drum is then set as a function of the pilot control pressure. This adjustment is intended to take place starting at a specific pivoting angle of the control lever which can be sensed by the operator by means of a pressure point. Previously, a great deal of adjustment work has been needed if, firstly, it is wished to have the same pilot control pressure in the two control outputs in each case, irrespective of the pivoting direction, after a specific pivoting angle of the control lever, and if this pilot control pressure is also intended to have a specific value.

The invention is based on the object of developing a hydraulic pilot control system having the introductory-mentioned features in such a way that, irrespective of the pivoting direction of the handle, after a specific pivoting angle, one simply has a specific pilot control pressure at one of the control outputs. The aim is also to configure the known hydraulic pilot control system more cost-effectively.

The object is achieved wherein a hydraulic pilot control system having the introductory-mentioned features, has a pressure valve which, when the handle is pivoted in the first direction and when the handle is pivoted in the second direction, can be adjusted with the same effect, and has a directional control valve which, depending on the pivoting direction of the handle from a rest position, which it assumes in the neutral position of the handle, can be changed over into a first switching position, in which it connects the control output of the pressure valve to the first control output, or into a second switching position, in which it connects the control output of the pressure valve to the second control output. Therefore, in the case of a hydraulic pilot control system according to the invention, only one pressure valve is provided for two pivoting directions of the handle. Therefore, tolerances in the components of the pressure valve no longer influence the difference in the values of the pilot control pressures after the handle has been pivoted by a specific pivoting angle. If the adjustment of the pressure valve as a function of the pivoting angle is made equal for both pivoting directions of the handle, then in each case the pilot control pressure is also irrespective of the pivoting direction. If it is wished to have a specific pilot control pressure at a specific pivoting angle, then it is necessary for only a single pressure valve to be adjusted. Furthermore, a directional control valve can generally be produced with less effort than a pressure valve having many individual parts. A hydraulic pilot control system according to the invention can therefore also be produced more cost-effectively.

For example, according to other features, in the rest position of the directional control valve, the two control outputs are relieved of pressure via a tank connection of the directional control valve, circumventing the pressure valve. Intrinsically, in the rest position of the directional control valve, relieving the pressure on the control outputs would also be possible via the pressure valve, since in the neutral position of the handle, the control output of the pressure valve is relieved of pressure.

According to still other features, the directional control valve preferably has, as a movable control element, a rotary slide, whose axis is aligned with the axis of rotation of the handle and which can be rotated via the handle in a valve bore in a valve housing. Even at large pivoting angles of the handle, there are no difficulties here in connecting the control element of the directional control valve and the handle to each other. The rotary slide is advantageously urged by an axial stop against a stop on the valve housing by a spring, so that it always assumes the same axial position and reliably controls the connections between individual ducts opening into the valve bore.

A refinement according to the invention is particularly preferred wherein there is a permanently set pressure reducing valve, which serves for the internal control pressure supply and which is accommodated in a space-saving way in an axial bore in the control element of the directional control valve, formed as a slider. One speaks of an internal control pressure supply when a pressure reducing valve generates from a high system pressure a significantly lower control pressure, which is fed to an adjustable pressure valve.

According to another feature of the invention, the relationship between the displacement of the pressure valve, at least over a large angle range, when the handle is pivoted in the second direction from the neutral position is the same as when the handle is pivoted in the first direction from the neutral position. This may easily be achieved by a control disk for the pressure valve which is appropriately configured and can be rotated by the handle. At the same pivoting angle, therefore, irrespective of the pivoting direction, in each case the same pilot control pressure is present on one of the two control outputs. This is particularly advantageous if a hydraulic appliance is to be controlled in the same way irrespective of the pivoting direction of the handle.

A specific pilot control pressure at a specific pivoting angle may be set in a particularly simple way by the pressure valve being adjustable from the outside after its components have been mounted in a housing. In this case, two advantageous possible ways of adjusting the pressure valve are provided. According to one way, an adjusting spring is provided, whose prestress can be varied by means of an adjustable stop, so that a total spring force which results from the force of the control spring and from the force of the adjusting spring and acts on the control element may be adjusted. According to another way, for the purpose of adjustment, the control edges fixed to the housing are displaced axially, so that the control position of the movable control element and, therefore, at a given axial position of the plunger, the prestress of the control spring in the control position of the control element is changed. By means of a combination of the features of these two ways, both the level of the pilot control pressure at a specific pivoting angle of the handle, and also the idle angle between the neutral position of the handle and the start of a pilot control pressure build-up can be adjusted.

A refinement according to the invention is particularly preferred wherein the plunger is guided in a guide sleeve. The control cartridge, which is inserted adjustably into a housing in order to vary the position of the control edges fixed to the housing, is extended beyond the control edges and accommodates the guide sleeve in a captive manner. The control cartridge, the guide sleeve and the movable parts of the pressure valve therefore form a structural unit, which can be handled as a whole and can be simply mounted as a whole in a housing. Reference is expressly made to the fact that the configuration of a pressure valve according to this refinement is also advantageous when this pressure valve is used in conventional pilot controllers, in which there is generally an adjustable pressure valve for every pivoting direction of the handle.

BRIEF DESCRIPTION OF THE DRAWINGS

An exemplary embodiment of a hydraulic pilot control system according to the invention is illustrated in the drawing. The invention will now be explained in more detail using the figures of this drawing, in which.

DETAILED DESCRIPTION OF THE PREFERRED EMBODIMENT

Figure 1:
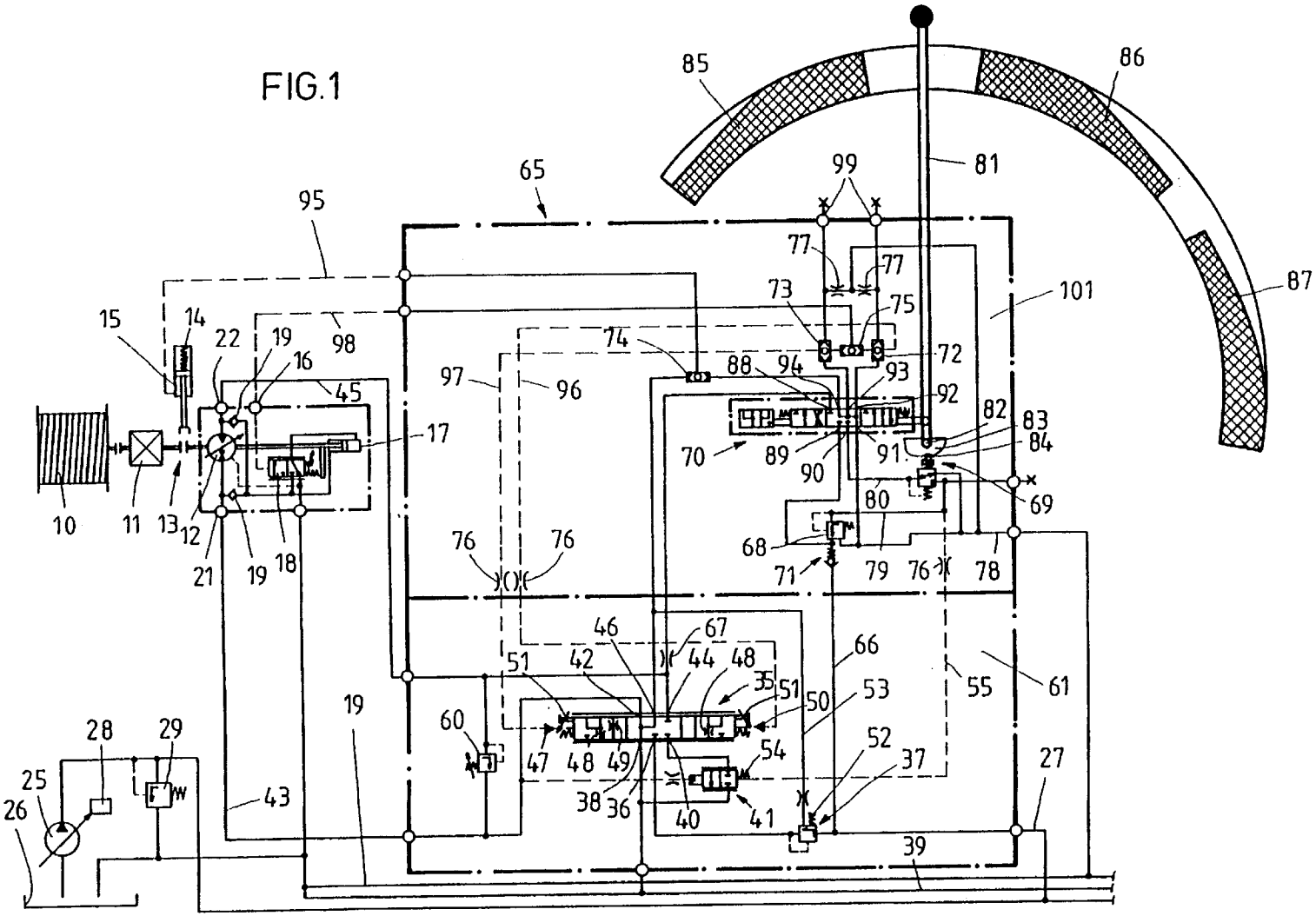
FIG. 1 shows the exemplary embodiment in a circuit diagram in which the control lever and the angle ranges in which the control lever is located during the various operating modes are also represented schematically.

FIG. 1 reveals a winch 10, which can be driven in opposite directions via a gearbox 11 via an adjustable hydraulic motor 12. Arranged between the output shaft of the hydraulic motor and the gearbox is a brake 13, which can be actuated via a single-acting hydraulic cylinder 14. The hydraulic cylinder 14 is constructed in the manner of a differential cylinder, whose piston and piston rod can be displaced by a spring with the effect of engaging the brake. By applying pressure medium to the annular chamber 15 of the hydraulic cylinder 14, piston and piston rod are moved back counter to the force of the spring and, as a result, the brake 13 is released. The absorption volume of the hydraulic motor 12 may be adjusted continuously on the basis of a control pressure applied to the control input 16, and is smaller the greater the control pressure. For the adjustment, there are an actuating cylinder 17 constructed as a differential cylinder and a pump control valve 18. The latter has a tank connection, which is connected to a leakage oil line 19, a pressure connection which is connected via two nonreturn valves 20 to the motor connection 21 or 22, respectively, and a cylinder connection connected to the pressure chamber, on the side remote from the piston rod, of the actuating cylinder 17. The pressure chamber on the piston rod side of the actuating cylinder 17 is connected to the pressure connection of the pump control valve 18. The piston slide of the pump control valve 18 is acted on with the effect of connecting the cylinder connection to the pressure connection of the control pressure and with the effect of connecting the cylinder connection to the tank connection by a first compression spring, set to a fixed value, and by a second compression spring whose prestress changes with the position of the piston and the piston rod of the actuating cylinder 17. The piston and piston rod of the actuating cylinder 17 therefore in each case assume a position such that the force generated as a result of the applied control pressure and the force generated by the springs maintain the equilibrium at the piston of the pump control valve 18. In this way, a specific absorption volume of the hydraulic motor 12 can be set by the control pressure.

The source for the pressure medium which is fed to the hydraulic motor 12 is a displacement pump 25, which takes hydraulic oil from a tank 26 and discharges it into a feed line 27. The displacement pump 25 is provided with a pressure controller 28, and therefore, when the pressure set on the pressure regulator 28 is reached in the feed line 27, pivots back to a swept volume which is sufficient to maintain the set pressure in the feed line 27. In order to safeguard the entire control arrangement against excessively high pressures, a pressure limiting valve 29 is connected to the feed line 27. The maximum swept volume of the displacement pump is designed in such a way that said pump is not pivoted as far as the stop even if, taking account of a simultaneous actuation of a plurality of hydraulic loads, the maximum quantity of pressure medium is requested.

The rotational speed at which the hydraulic motor 12 rotates and the direction of rotation can be controlled by a proportionally adjustable directional control valve 35. This is spring-centered into a mid-position and can be actuated hydraulically. It has a total of six connections, namely a feed connection 36, to which pressure medium can flow from the feed line 27 via a pressure compensator 37, an outlet connection 38, which is connected directly to a tank line 39, a second outlet connection 40, which is connected via a brake valve 41 to the tank line 39, a first load connection 42, which is connected via a load line 43 to the motor connection 21, a second load connection 44, which is connected via a load line 45 to the motor connection 22, and a brake connection 46, via which pressure medium can be applied to the annular chamber 15 of the hydraulic cylinder 14.

In the spring-centered mid-position of the directional control valve 35, its connections 36, 40 and 44 are blocked off. The connections 42 and 46 are connected to the connection 38 and therefore to the tank 26. By applying a control pressure to a first control chamber 47, the valve piston of the directional control valve 35 is displaced to a different extent, depending on the level of the control pressure, into a first operating position, in which the outlet connection 38 is blocked off. The load connection 42 and the brake connection 46 are jointly connected to the feed connection 36 via a feed metering diaphragm 48, whose opening cross section depends on the extent of the displacement of the valve piston. The load connection 44 is connected via an outlet restrictor 49 to the outlet connection 40. If the control chamber 47 is relieved of pressure, and if a second control chamber 50 has a control pressure applied to it, then the valve piston of the directional control valve 35 passes to a different extent from the mid-position into a second operating position, in which the load connection 42 is connected in an unrestricted manner to the outlet connection 38. The brake connection and the other load connection 44 are jointly connected to the feed connection 36 via the feed metering diaphragm 48. The outlet connection 40 is blocked off. The maximum displacement travel of the valve piston in the two opposite directions is limited by adjustable stops 51.

According to the connections outlined, the pressure compensator 37 is arranged between the various connections of the directional control valve 35 in the two operating positions of the latter, in each case upstream of the feed metering diaphragm 48. The control piston of the pressure compensator 37 is acted on in the closing direction by the pressure upstream of the feed metering diaphragm and in the opening direction by a compression spring 52 and by a pressure which is applied via a control line 53, which is connected to the brake connection of the directional control valve and therefore in each case to the load connection 42 or 44 of the directional control valve 35 in the flow to the hydraulic motor 12. The pressure is therefore in each case equal to the pressure downstream of the feed metering diaphragm 48. The pressure compensator 37 therefore controls a specific pressure difference, equivalent to the force of the spring 52, across the feed metering diaphragm 48. The quantity of pressure medium flowing via the feed metering diaphragm 48 therefore depends only on the opening cross section of the feed metering diaphragm and is independent of the load pressure and of the pump pressure.

The control piston of the brake valve 41 is acted on in the opening direction by the pressure present on the load connection 42 of the directional control valve 44 and therefore also present in the load line 43 and at the motor connection 21, and is acted on in the closing direction by the force of a compression spring 54 and by a pilot control pressure applied via a control line 55, which is constantly in the region of 40 bar, for example. The two pressures act on equally large areas, so that under a pulling load, the brake valve 41, together with the restrictor 49, restricts the outflow of pressure medium from the hydraulic motor 12 via the load line 45 in each case to such a great extent that, in the load line 43, a pressure is built up which produces a force on the control piston of the brake valve which maintains the equilibrium of the force of the compression spring 54 and the force generated by the pilot control pressure. The rotational speed of the hydraulic motor 12 is therefore also determined by the opening cross section of the feed metering diaphragm 48 when under a pulling load. In addition, the pressure on the brake connection 46 of the directional control valve 35 is so high under a pulling load that the brake 13 remains released.

Arranged between the two load lines 43 and 45 is a pressure limiting valve 60, which is set to a pressure which is about 10–20 bar above the pressure controlled by the displacement pump 25, but below the set pressure of the pressure limiting valve 29.

The directional control valve 35, the pressure compensator 37, the brake valve 41 and the pressure limiting valve 60 are accommodated in a valve plate 61. Built up on the latter is a pilot controller 65, via which a bypass line 66 which can be blocked off leads, which originates from the feed line 27 upstream of the pressure compensator 37 and opens into the load line 45, that is to say circumvents the pressure compensator 37 and the directional control valve 35. Located in the bypass line 66 is a nozzle 67, which is located in the plate 61 and through which the quantity of pressure medium which can flow to the hydraulic motor 12 via the bypass line 66 is limited to about 10% of the quantity of pressure medium which flows to the hydraulic motor 12 via the directional control valve 35 when the feed metering diaphragm 48 is at its maximum opening.

The pilot controller 65 contains two pressure reducing valves 68 and 69, a directional control valve 70, a nonreturn valve 71, various changeover valves 72, 73, 74 and 75, two damping nozzles 76, two relief nozzles 77 and various ducts for connecting the valves to one another. The nonreturn valve 71 is in the bypass line 66 and blocks toward the feed line 27. Downstream of the nonreturn valve 71, the pressure reducing valve 68 is connected to the bypass line 66 by its pressure connection. A relief connection of the pressure control valve 68 is connected to a leakage duct 78. The pressure reducing valve 68 is set to a fixed value and, at its control output and in a pilot control pressure supply duct 79, to which the control line 55 leading to the brake valve 41 is also connected, for example controls the aforementioned pressure at the level of 40 bar. The second pressure reducing valve 69, which is connected by its pressure connection to the duct 79, by its relief connection to the duct 78 and by its control output to a pilot control pressure duct 80, can be adjusted by pivoting a control lever 81 from a neutral position. The pivot axis of the control lever 81 is designated by 82. Fixed to the control lever is a control disk 83 having a control cam on which an actuating plunger 84 of the pressure reducing valve 69 bears. The control cam is configured such that when the control lever is pivoted from the neutral position, first of all the pressure reducing valve 69 is adjusted in the same way, irrespective of the pivoting direction. To be specific, the pilot control pressure in the duct 80 increases continuously, starting from a pivoting angle of about 8 degrees up to the pivoting angle of 45 degrees, even if not necessarily with the same slope everywhere. The pivoting angle of the control lever 81 is limited to about 50 degrees for the pivoting in one direction. In this direction, the control lever is pivoted for the purpose of easing, that is to say for unwinding the hawser from the winch 10. Pivoting the control lever in the other direction is carried out for the purpose of hoisting, that is to say when the hawser is to be wound up on the winch 10. In this case, both when being pivoted in the direction of easing and when being pivoted in the direction of hoisting, the control lever 81 pivots back into its neutral position again, because of a restoring device acting on it, when it is released. In the hoisting direction, however, the control lever can be pivoted up to a pivoting angle of about 100 degrees, remaining in the position assumed by it when it is pivoted over about 54 degrees, even when it is released. In this range, the winch 10 is operated in the mooring mode. The three angular ranges of easing, hoisting and mooring are indicated hatched in FIG. 1 and provided with reference numbers 85 for easing, 86 for hoisting and 87 for mooring. Here, the control disk 83 is configured such that in the mooring angle range 87 the pressure in the duct 80 decreases as the pivoting angle of the control lever 81 increases.

The directional control valve 70 is actuated mechanically by the control lever 81. Its movable valve element is constructed as a rotary slider 181 (see FIGS. 9 and 10), whose axis of rotation coincides with the axis 82 of the control lever 81. It can assume a total of four functionally distinguishable switching positions and has 7 connections, of which two connections 88 and 89 are downstream of the nonreturn valve 71 and upstream of the nozzle 67 in the bypass line 66. The pilot control pressure duct 80 leads to one connection 90. One connection 91 is connected to the leakage duct 78. The three remaining connections 92, 93 and 94 each lead to a first input of a changeover valve 72, 73 and 74, respectively. The second input of the changeover valve 74 is connected to the brake connection 46 of the directional control valve 35. A line 95 leads from the output of this changeover valve to the annular chamber 15 of the hydraulic cylinder 14. The second input of each of the two changeover valves 72 and 73 is respectively connected to an external connection 95, which is closed in the present case but offers the possibility of controlling the winch with a second pilot controller, which is arranged at a distance from the block comprising the plate 61 and the pilot controller 65. For the case of this remote control, and for the case of small pilot control pressures, the line between the connection 46 of the directional control valve 35 and the changeover valve 74 is needed, since the annular chamber 15 of the hydraulic cylinder 14 can then be pressurized via this line. From the output of the changeover valve 72, a control line 96 leads via a damping nozzle 76 to the control chamber 50, and from the output of the changeover valve 73, likewise via a damping nozzle 76 of a control line 97 leads to the control chamber 47 of the directional control valve 35. The changeover valve 75 is connected by one input to the output of the changeover valve 72 and by its other input to the output of the changeover valve 73. Its output is connected via a control line 98 to the control input 16 of the hydraulic motor 12.

In the neutral position of the control lever 81, the directional control valve 70 assumes a position in which the connections 88, 89 and 90 are blocked off and the other connections are connected to the tank duct 78. The bypass line 66 is therefore blocked. The control lines 95, 96, 97 and 98 are relieved of pressure in relation to the duct 78. The directional control valve 35 is therefore in its midposition. The hydraulic motor 12 is at maximum absorption volume. The brake 13 is engaged.

The control lever is then adjusted into the angle range 85 for easing. As a result, the directional control valve 70 moves into a switching position, in which the connections 89 and 94, the connections 90 and 93 and the connections 91 and 92 are respectively connected to each other. Therefore, the control chamber 47 of the directional control valve 35 has a control pressure applied to it via the connections 90 and 93 and the changeover valve 73 and the control line 97. This control pressure is also present on the control input 16 of the hydraulic motor 12 via the changeover valve 75 and the control line 98. The control chamber 50 of the directional control valve 35 is relieved of pressure via the control line 96, the changeover valve 72 and the connections 91 and 92 of the directional control valve 70, and via the one relief nozzle 77. The directional control valve 35 is therefore moved into a position in which the feed connection 36 is connected via the feed metering diaphragm 48 to the load connection 42 and to the brake connection 46. In the load line 43 and in the feed line 27, a pressure builds up which, via the changeover valve 74, is also present in the annular chamber 15 of the hydraulic cylinder 14 and is finally sufficient to release the brake. Pressure medium delivered by the hydraulic pump 25 can then flow via the feed line 27, the pressure compensator 37, the directional control valve 35 and the load line 43 to the hydraulic motor 12 and, from there, via the load line 25, the restrictor opening 49 of the directional control valve 35 and via the brake valve 41, to the tank 26. The hawser is unwound from the winch 10. In the process, even when a pulling load hangs on the hawser, the brake valve 41 ensures that the outflow of pressure medium from the hydraulic motor 12 to the tank can only take place in a restricted manner so that a specific pressure is maintained in the load line 43. This pressure is sufficient to hold the brake 13 released. In addition, the speed at which the hawser is paid out is determined only by the control pressure, which depends on the deflection of the control lever 81. In this case, the speed of the winch 10 is influenced in two ways. Up to about a deflection angle of 25 degrees, only the directional control valve 35 is adjusted, but not the hydraulic motor 12. The latter remains at the maximum absorption volume and maximum torque. The torque is indicated in FIG. 1 by the radial extent of the fields 85, 86 and 87. After a deflection of the control lever 81 of 25 degrees, the directional control valve 35 is completely open. During further deflection of the control lever 81, the absorption volume of the hydraulic motor 12 is then reduced, as a result of which its rotational speed is increased, but its torque is reduced. This is indicated by the decreasing radial extent of the field 85 in FIG. 1.

If, starting from the neutral position shown, the control lever 81 is pivoted into the hoisting angle range 86, then the directional control valve 70 comes into a position in which the connections 89 and 94 are again connected to each other. However, the connection 90 is now connected to the connection 92 and the connection 91 to the connection 93. The control chamber 47 is therefore depressurized, and the control chamber 50 of the directional control valve 35 has applied to it a pilot control pressure dependent on the deflection angle of the control lever 81. This pressure is also present on the control input 16 of the hydraulic motor 12. The directional control valve moves into its second operating position, in which pressure medium delivered by the displacement pump 25 can flow via the feed line 27, the pressure compensator 37, the connections 36 and 44 with the feed metering diaphragm 48 located between them, and via the load line 45, to the hydraulic motor 12. The outflow of the pressure medium from the hydraulic motor 12 takes place via the load line 43 and the connections 42 and 38 of the directional control valve 35 to the tank 26. In the load line 45 and in the feed line 27, a load-dependent pressure is built up which is sufficient to release the brake 13. The hawser is then wound up on the winch 10.

If the control lever 81 is pivoted still further into the mooring angle range 87, then the directional control valve 70 passes into a switching position in which the connections 88 and 94 are connected to the connection 89. Accordingly, the bypass line 66 is open for the flow of pressure medium, and the annular space 15 of the hydraulic cylinder 14 is connected to the bypass line downstream of the nonreturn valve 71. The connection 91 of the directional control valve 70 is blocked off. The connections 92 and 93 are connected to the connection 90, and therefore to the control output on the pressure reducing valve 69. The same pilot control pressure is therefore present in both the control chambers of the directional control valve 35, so that the latter returns into the mid-position on account of its spring centering. The pilot control pressure is also present on the inlet 16 of the hydraulic motor 12. In this case, the control cam of the control disk 83 is configured in such a way that, at the start of the mooring angle range, the pilot control pressure is so high that the hydraulic motor is set to its minimum absorption volume. The torque that can be exerted by the hydraulic motor 12 is therefore also a minimum. As the deflection of the control lever 81 increases in the mooring angle range 87, the pilot control pressure decreases continuously, so that the absorption volume and therefore the torque that can be exerted by the hydraulic motor 12 increases continuously. This is beneficial in terms of working physiology.

In the mooring angle range 87, pressure medium can still flow to the connection 22 of the hydraulic motor 12 only via the bypass line 66. This feed flow is limited by the nozzle 67, so that in the mooring mode, the rotational speed of the hydraulic motor and therefore the speed with which the hawser is wound up is limited. This is important for operational safety. This is because, since the control lever 81 in the mooring angle range 87 maintains its position, even without the action of an external force, there is the possibility that a person will firstly place the control lever in the mooring angle range and then do something with the hawser or stay in the area of the hawser. As a result of the nozzle 67, the speed at which the hawser is moved is now limited to a low speed. Even if the hawser breaks, the speed at which the hawser is then wound up is low, because of the nozzle 67, even though it may be somewhat higher than under load.

Figure 2:
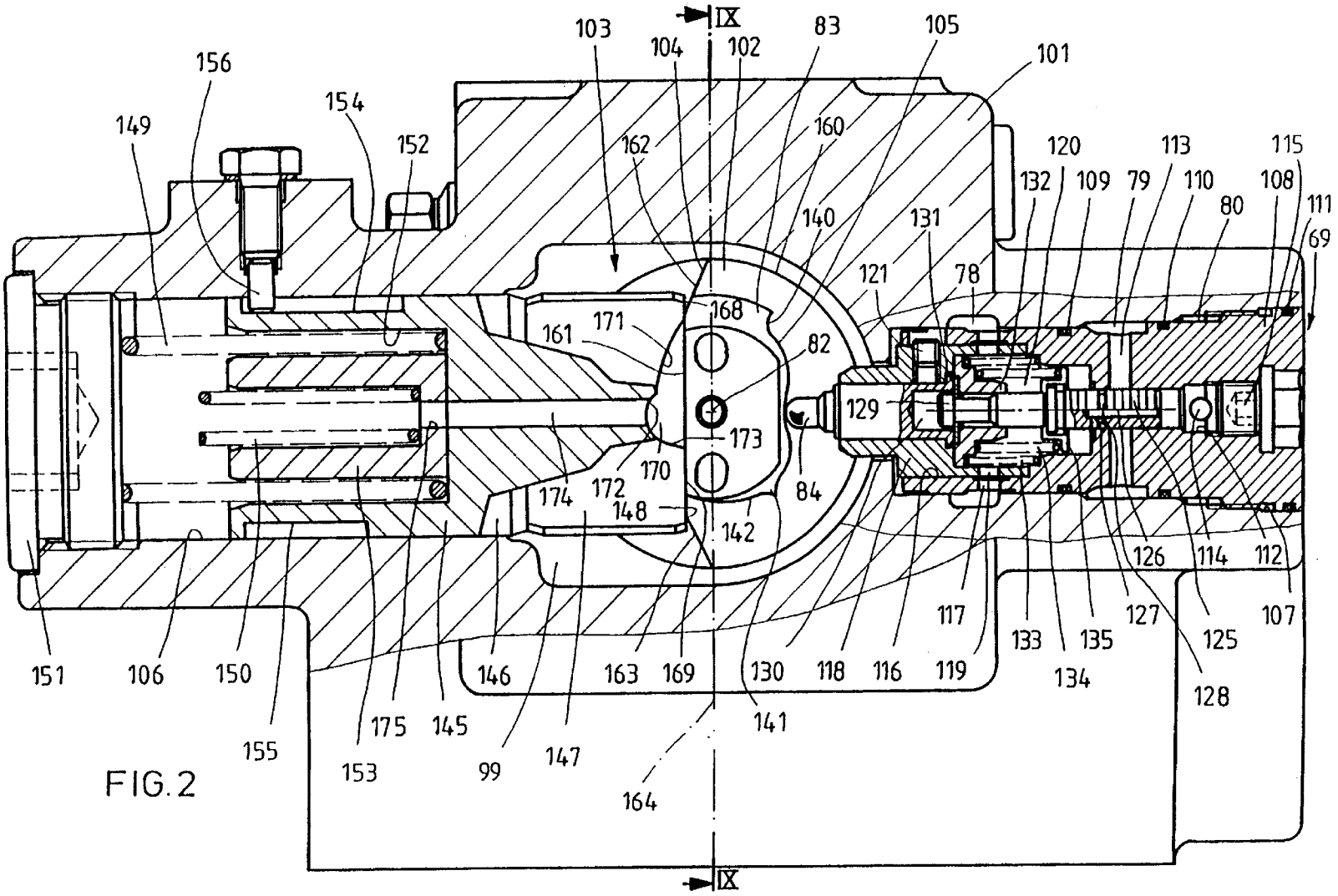
FIG. 2 shows a partial section through a pilot controller at right angles to the axis of the control lever, the section plane for the restoring device and the housing being different from that for the pilot control valve.

The control lever 81 is fixed to a shaft 183 which projects from the housing 101 of the pilot controller 65 and with which, as FIG. 2 reveals, within the housing 101 a cam disk 102 with a cam track 104 cooperating with a restoring device 103, and the control disk 83 axially immediately adjacent to the cam disk 102 and having a control cam 105 cooperating with the plunger 84 of the pressure reducing valve 69 are coupled in a rotationally secure manner. The cam track 104 and the control cam 105 are in each case part-cylindrical surfaces which extend axially over a certain distance. The cam disk 102 and the control disk 83 are located in a relatively large cavity 99 in the housing 101, into which there open two housing bores 106 and 107 which are located diametrically opposite but, in accordance with the axial offset of the cam disk 102 and control disk 83, are likewise offset axially in relation to each other. The housing bore 106 accommodates the parts of the restoring device 103. The pressure reducing valve 69 is inserted into the housing bore 107.

This pressure reducing valve 69 can be adjusted from the outside in such a way that a quite specific pilot control pressure prevails in the duct 80 at a selected deflection angle of the control lever 81. At this selected deflection angle, the intention is for the directional control valve 35 to be fully open and for the displacement of the hydraulic motor 12 to begin. For the purpose of adjustment, the pressure reducing valve 69 has a control cartridge 108, which is screwed into the housing bore 107 from the externally open end of the latter. The control cartridge 108 is stepped three times on the outside and, at each step, has a seal 109, 110 and 111. Formed between the seal 109 with the smallest diameter and the middle seal 110, between the control cartridge 108 and the housing 110, is an annular chamber, which is part of the control pressure supply duct designated by 79 in FIG. 1 and in which there prevails the pressure regulated by the pressure reducing valve 68 at the level of 40 bar. Axially between the two seals 110 and 111, on the outside of the control cartridge 108, there is a further annular chamber, which belongs to the pilot control pressure duct 80 from FIG. 1. A further annular chamber between the control cartridge 108 and the housing 101 is created in front of the seal 109, this annular chamber belonging to the leakage duct 78 from FIG. 1.

The central passage 112 through the control cartridge 108 has sections lying axially one behind another with different cross sections. A bore section with the smallest diameter is located axially approximately between the seals 109 and 110 and, via two radial holes 113, is open to the annular chamber 79. It merges outward into a bore section which is somewhat larger and partially provided with an internal thread and from which there lead radial holes 114 which open into the annular chamber 80. Screwed into the bore section is a grub screw 115, by means of which the aforementioned bore sections are closed off to the outside. On the other side of the grub screw 115, the passage is formed as an internal polygon, on which a tool can be attached for the purpose of rotating and therefore for the purpose of axial adjustment of the control cartridge 108. The bore section into which the radial holes 113 open merges inward into an accommodation chamber 116, which is again stepped and from which radial holes 117 lead into the annular chamber 78. Inserted into this accommodation chamber 116 is a guide bush 118 for the plunger 84 of the pressure regulating valve 69, said guide bush being captively secured therein by a grub screw 121. The guide bush has radial holes 119, via which, together with an annular chamber placed between the control cartridge 108 and the guide bush 118, a spring chamber 120 formed between the control cartridge 108, the guide bush 118 and the plunger 84 is connected to the annular chamber 78 and therefore to the tank.

The passage section into which the radial holes 113 open is used as a guide bore for a control piston 125 and, together with the control piston, controls the connections between the various annular chambers 78, 79 and 80. The edges between the radial holes 113 and the bore section, on the one hand, and the edge between the bore section and the relatively large spring chamber 120, on the other hand, form the control edges in this case. The control piston 125 is a hollow piston having an axial blind bore 126, which is open toward the radial holes 114 and is connected via a plurality of radial holes 127 to the outer side of the control piston. The radial holes 127 merge on the outside into an annular groove 128. The axial extent of the annular groove, including the radial holes 127, is slightly smaller than the clear axial spacing between the control edges on the control cartridge 108, so that it is possible to separate the blind bore 26 with a positive overlap both from the radial holes 113 and from the spring chamber 120. The control piston 125 extends through the spring chamber 120 and projects with a head 129 into a blind bore 130 in the plunger 84. With the head 129, it engages behind a disk 131, which is arranged between the plunger 84 and a spring plate 132, and holds the head 129 in the manner of a slotted securing ring. A restoring spring 133 accommodated by the spring chamber 120 and intended for the plunger 84 is supported at one end on the control cartridge 108 and at the other end, via the spring plate 132 and the disk 131, on the plunger 84 and presses the plunger against the control cam 105. Also accommodated by the spring chamber 120 is a control spring 134, which is clamped in between a spring plate 135 bearing on a shoulder of the control piston 125 and the spring plate 132, and which ensures that, in the rest position shown of the plunger 84, the head 129 of the latter bears on the disk 131.

The pressure limiting valve 69 is arranged with respect to the axis of the control lever 81 such that the axis of the plunger 84 intersects the axis 82 of the control lever 81 at right angles. Starting from a central neutral line, in which its distance from the axis 82 is a minimum and on which the plunger 84 bears in the neutral position of the control lever 81, the control cam 105 is initially of the same shape on both sides. Its distance from the axis 82 increases continuously. Toward one side, the control cam 105 ends in a surface section 140 which extends radially outward, for which the plunger 84 acts as a stop and which therefore limits the pivoting angle of the control lever 81 in one direction. In the other direction, approximately at the same distance from the center line as the control cam section 140, there is a small elevation 141, on account of which, during the pivoting of the control lever 81, the torque rises briefly and it is therefore indicated to the operator that a change is being made from one operating range into a second operating range. Following the elevation 141,the distance of the control cam from the axis 82 decreases in the control cam section 142.

In the neutral position of the control cam 105 shown in FIG. 2, the plunger 84 and, with it, the control piston 125 of the pressure reducing valve 69 is in a position in which the annular chamber 80 has a fluidic connection to the annular chamber 78 via the blind hole 126, the radial holes 127, the spring chamber 120, the radial holes 119 and the radial holes 117. If the control lever is then deflected, then the plunger 84 is displaced into the control cartridge 108. Via the control spring 134, the control piston 125 is carried with it, so that the connection between the blind hole 126 and the annular chamber 78 is interrupted, and a connection between the blind hole 126 and the annular chamber 79 is opened. From the latter, pressure medium can then flow through the control piston 125 into the annular chamber 80 and onward to one or both control chambers 47 and 50 of the directional control valve 35. A pressure is built up by means of which the control piston 125 is pushed back against the control spring 134 until equilibrium prevails between the hydraulic force and the spring force. The control piston 125 then assumes a control position. The level of the pilot control pressure in the annular chamber 80 is in this case determined by the prestress which the control spring 134 has in the given position of the plunger 84 in the control position of the control piston 125. This prestress, and therefore also the pilot control pressure in the given plunger position, can be adjusted. For this purpose, the control cartridge 108 is screwed somewhat into the housing 101 or somewhat out of the housing 101. As a result, the control position of the control piston 125 also changes and, therefore, at a given plunger position, the prestress of the control spring 134 and therefore the level of the pilot control pressure. The pilot control pressure increases as a result of the control cartridge 108 being screwed in, and decreases as a result of said control cartridge being screwed out. For a selected position of the control lever 81, a specific pilot control pressure can therefore be adjusted. Away from the selected position of the control lever 81, on the other hand, specimen scatter may still occur, since the stiffness of the control springs used in different specimens varies.

The restoring device 103 comprises a pressure piece 145 which is guided in the housing bore 106 by a cylindrical section 146 and by a double flat 147, whose flat faces are aligned perpendicular to the axis 82, said pressure piece 145 projecting into the hollow chamber 99 and being pressed against the restoring cam track 104 with its end 148 extending parallel to the axis 82. A pressing force is exerted over the entire pivoting range by a restoring spring 149. In addition, in the mooring angle range designated by 87 in FIG. 1, a further pressure spring 150 acts. The springs are located in a spring chamber between the pressure piece 145 and a closing screw 151 screwed into the housing bore 106. In order to accommodate springs of the necessary length, the pressure piece 146 has a blind hole 152 which is open toward the closing screw 151 and between whose base and the closing screw 151 the restoring spring 149 is clamped. Within the restoring spring 149 there is a bush 153, which is likewise open to the closing screw 151 and in whose blind hole the pressing spring 150 is accommodated for the major part. In the position shown in FIG. 2 of the pressure piece 145, in which the latter is at its greatest distance from the closing screw 151, the pressing spring 150 is completely unstressed. The pressing spring 150 becomes effective only after a specific travel of the pressure piece 145 toward the closing screw 151.

Within the guide section 146, the pressure piece 145 has, on its outer side, two diametrically opposite, axially extending grooves 154 and 155, which are of different lengths but begin at the same distance from that end of the pressure piece 145 which faces the closing screw 151. A pin 156, which is held in the housing 101, engages in the groove 154 with slight play. The pressure piece 145 is secured against rotation by the pin 156. The groove 154 is sufficiently long for the axial movement of the pressure piece 145 not to be limited by the pin 156.

The cam track 104 is substantially composed of four flat cam sections which can be distinguished from one another. One cam section 160 extends over 180 degrees around the axis 82 and is circularly cylindrically curved, that is to say has the same distance from the axis 82 everywhere. In the neutral position of the control lever 81 and therefore of the cam track 104, as shown in FIG. 2, the axial plane 164 which goes through the axis 82 and the ends of the cam section 160 is perpendicular to the axis of the pressure piece 145. Between the two ends of the cam section 160 there are three flat, level cam sections 161, 162 and 163, which run at an angle to one another. The central cam section 161 of these three cam sections extends at a short distance from the plane 164, parallel to the latter. The two cam sections 162 and 163 run at an angle to the cam section 161 toward the cam section 160.

That end 148 of the pressure piece 145 which faces the cam track 104 has two level surface sections 168 and 169 which are aligned with each other and perpendicular to the axis of the pressure piece 145, and extend inward to different extents from the round side surface sections of the double flat 147. In this case, the surface section 169 is substantially longer than the surface section 168. Between these two surface sections, a continuous recess 170 perpendicular to the flat sides is introduced into the end 148 and, starting from the inner end of the surface section 168, is bounded by a uniformly curved surface 171, whose curvature is equal to the curvature of the cam section 160 of the cam track 104. The surface 171 is adjoined by a channel 172, which is located centrally in the end of the pressure piece. One side of the channel 171 merges into the flat surface section 169 at a stop face 173.

Into the channel 172 there opens an axial bore 174 which passes through the pressure piece 145 and in whose extension the base of the bush 153 also has an axial bore 175. The spring chamber that accommodates the springs 149 and 150 is therefore continuously connected fluidically to the hollow chamber 99 in the housing 101. The hollow chamber 99 is in turn located in the leakage line 78.

Figure 3:
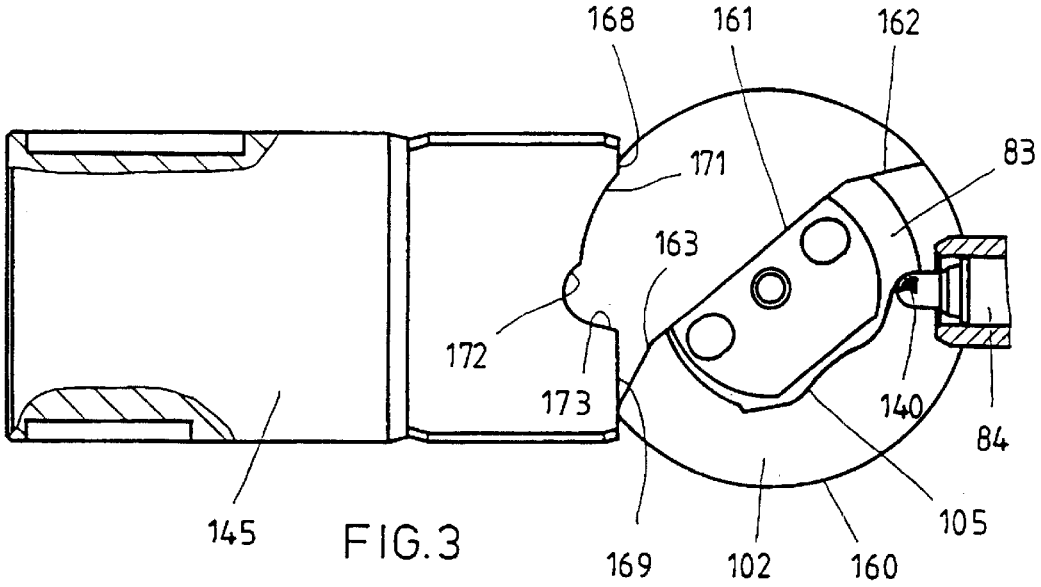
FIG. 3 shows the shaft which can be rotated by the control lever and has cam tracks, the pressure piece of the restoring device and a plunger belonging to the pilot control valve in a position which the parts assume when the control lever is deflected to the maximum in the easing direction.

To ease, that is to say to unwind the hawser from the winch 10, the control lever 81 is pivoted into the easing angle range 85 according to FIG. 1. As a result, the control disk 83 and the cam disk 102 are rotated in the clockwise direction in the view of FIG. 2. In the process, firstly the corner between the cam sections 161 and 163 slides along on the surface section 169 of the pressure piece 145. As a result, the pressure piece is displaced in the direction of the closing screw 151, so that the prestress of the restoring spring 149 is increased continuously. If the control lever is released at any point, then the pressure piece 145 and the control lever return into the neutral position shown in FIG. 2, under the action of the restoring spring 149. However, if the control lever 81 is pivoted still further in the direction of easing, then the cam section 163 finally rests flat on the surface section 169 of the pressure piece 145. During a further deflection of the control lever, the point of action of the pressure piece 145 moves abruptly further away from the axis 82 of the control lever toward the corner between the cam section 163 and the cam section 160. This manifests itself in a steep rise in the torque exerted by the restoring device 103 on the control lever. This indicates to the operator that the directional control valve 35 from FIG. 1 is now completely open and, during the further pivoting of the control lever 81, the absorption volume of the hydraulic motor 12 will be reduced. When the cam sections 163 and 169 rest flat on each other, then the pilot control pressure should have the specific level which is set by adjusting the pressure regulating valve 69. During further deflection, the corner between the cam section 160 and the cam section 163 then slides along on the surface section 169, as a result of which the pressure piece 145 is displaced further in the direction of the closing screw and the restoring spring 149 is prestressed further. Finally, an end position is reached as shown in FIG. 3. The control disk 83 has struck the plunger 84 of the pressure reducing valve 69 with the section 140 of the control cam 105 and can no longer be rotated further. If the control lever is released, it returns into its neutral position again under the action of the restoring device 103.

Figure 4:
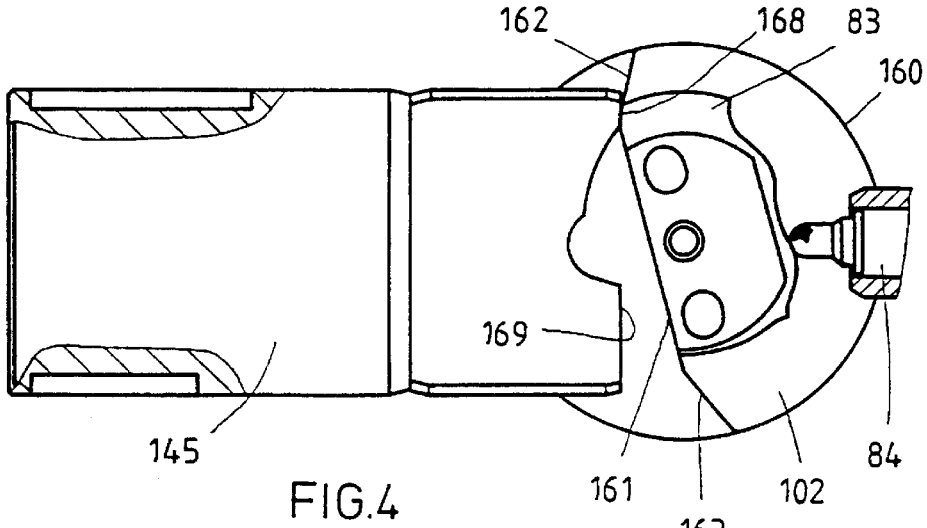
FIG. 4 shows the same parts as in FIG. 3 in a position in which the control lever has been deflected from its neutral position through 15° into the hoisting angle range.
Figure 5:
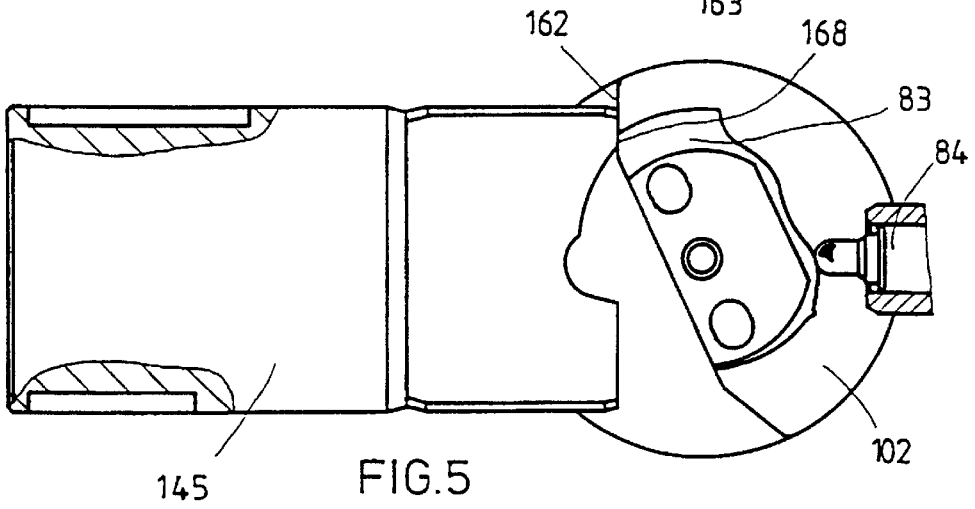
FIG. 5 shows the same parts as in FIG. 4 after a deflection of the control lever through 25°.
Figure 6:
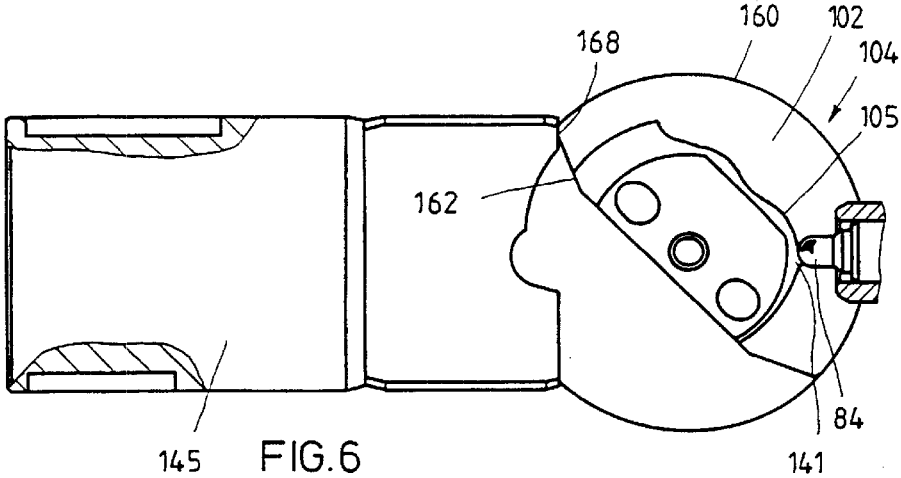
FIG. 6 shows the parts from FIG. 5 after a deflection of the control lever through 45° as far as the end of the hoisting angle range.

If the control lever 81 is pivoted from its neutral position, in which, as FIG. 2 reveals, the cam section 161 of the cam track 104 and the surface sections 168 and 169 of the pressure piece 145 bear flat on one another, in the direction of hoisting, then the control disk 83 and the cam disk 102 are rotated in the counterclockwise direction in the view of FIG. 2. The pressure piece 145 acts on the cam track 104 at the corner between the cam sections 161 and 162, as shown in FIG. 4. During the further pivoting of the control lever 81, the cam section 162 of the cam track 102 finally comes to bear flat on the surface section 168 of the pressure piece 145. This state is shown in FIG. 5. During further pivoting of the control lever 81, the operator notices a sharp rise in the necessary actuating force and is therefore given an indication that the absorption volume of the hydraulic motor 12 is then being adjusted. Finally, the surface 168 of the pressure piece 145 bears on the corner between the cam section 162 and the cam section 160 of the cam track 104, as FIG. 6 shows. There, the control lever 81 has already been rotated to such an extent that the plunger 84 of the pressure reducing valve 69 has struck the elevation 141 on the control cam 105. This manifests itself to the operator in a further pressure point during the pivoting of the control lever 81. This indicates that, during further pivoting of the control lever, the hoisting angle range 86 will be left. When the control lever 81 is released in the hoisting angle range, the restoring device 103 is able to return the control lever into its neutral position again, since any further deflection of the control lever in this range is associated with an increase in the prestress of the restoring spring 149.

Figure 7:
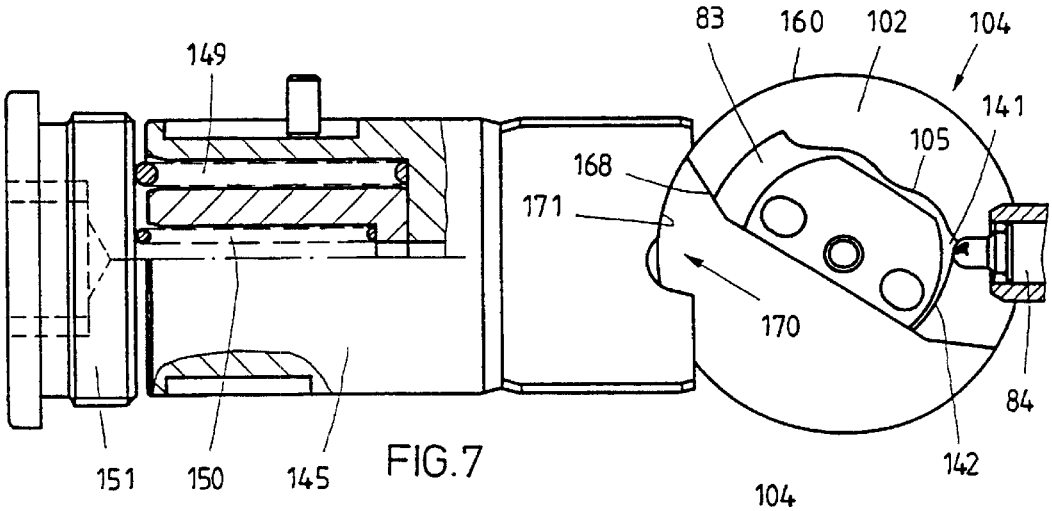
FIG. 7 shows the parts from FIG. 6 after a deflection of the control lever through 57° as far as the start of the mooring angle range.
Figure 8:
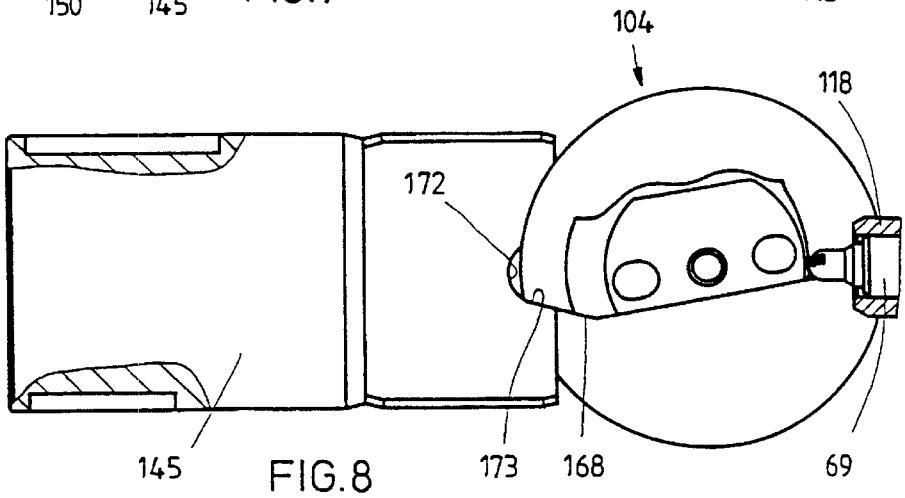
FIG. 8 shows the parts from FIG. 7 after the control lever has been pivoted through 100° as far as the end of the mooring angle range.

If the control lever is pivoted further, with the increased expenditure of effort, which is needed for the plunger 84 to overcome the elevation 141, then, first of all, the edge between the two cam sections 168 and 160 and, to an ever increasing extent, the cam section 160 passes into the region of the recess 170 in the pressure piece 145, where the cam section 160 bears on the surface 171 of the recess 170. In the positions shown in FIG. 6 of the individual components, the pressure piece 145 has been displaced to such an extent in the direction of the closing screw 151 that the pressing spring 150 is still just located in an unstressed condition between the pressure piece and the closing screw. During the further rotation of the cam disk 102 in the counterclockwise direction, the pressure piece is displaced still further toward the closing screw and, as a result, the pressing spring 150 is stressed, until finally the edge between the cam sections 160 and 168 of the cam track 104 passes into the region of the recess 170 in the pressure piece 145. FIG. 7 shows a state in which the plunger 84 has just overcome the elevation 141 on the control cam 105, and the cam section 160 of the cam track 104 has dipped slightly into the recess 170 and bears on the surface 171 there. The pressure piece 145 is then pressed against the cam section 160 of the cam track 104 by the force of the spring 149 and additionally by the force of the spring 150. Since the curvatures of the cam section 160 and of the surface 171 are the same, further pivoting of the control lever no longer leads to increased prestressing of the springs 149 and 150. These therefore no longer exert any restoring force on the control lever. The control lever is located in the mooring angle range 87. The distance between the hoisting angle range and the mooring angle range is about 10 degrees, in which the plunger 84 overcomes the elevation 141 on the control cam 105. The increase in the pilot control pressure which occurs in the process has no effect on the directional control valve 35 or the hydraulic motor 12, since at the end of the hoisting angle range, the directional control valve 35 is fully open and the hydraulic motor 12 is set to its smallest absorption volume. At the end of the mooring angle range 87 from FIG. 1, the cam section 168 of the cam track 104 strikes the stop face 173 of the recess 170, as shown in FIG. 8. Further pivoting of the control lever 81 is no longer possible.

On the other side of the elevation 141, the control cam 105 in the region 142 is shaped such that with further deflection of the control lever, the plunger 84 emerges further and further from the guide bush 118, so that the springs of the pressure reducing valve 69 exert a torque on the control lever 81 with the effect of further deflection. The frictional forces between the pressure piece 145 and the cam disk 102 and between the plunger 84 and the control disk 83 are so high, however, that the control lever maintains its position in the mooring angle range even when it is released.

FIG. 8 also reveals in particular the effect of the channel 172 in the recess 170 in the pressure piece 145. By means of this channel, an exchange of pressure medium between the spring chamber with the springs 149 and 150 and the hollow chamber 99 in the housing 101 is ensured in a simple way even if the control lever 81 has been pivoted as far as the end of the mooring angle range.

The groove 155 in the pressure piece 145 is of no significance for a control arrangement with a mooring mode of the winch. However, not every winch is also provided for the mooring mode. The groove 155 permits the pressure piece 145 also to be used for a winch without the mooring mode. For this purpose only, as compared with the state shown in FIG. 2, it is incorporated in the housing 101 rotated through 180 degrees about its longitudinal axis. The pin 156 then engages in the groove 155. Because of the shortness of this groove, the pin 156 limits the travel by which the pressure piece 145 can be displaced toward the closing screw 151. This therefore provides a stop for the control lever at the end of the hoisting angle range. The pin 156 can likewise become effective at the end of the easing angle range. Depending on the length of the groove 155, however, it is possible for the plunger 84 already to have struck the surface 140 of the control cam 105 previously. The groove 155 therefore permits a pilot controller for a winch without the mooring mode and a winch with the mooring mode to be constructed with the same pressure piece 145. Likewise, an existing winch can be converted.

Figure 9:
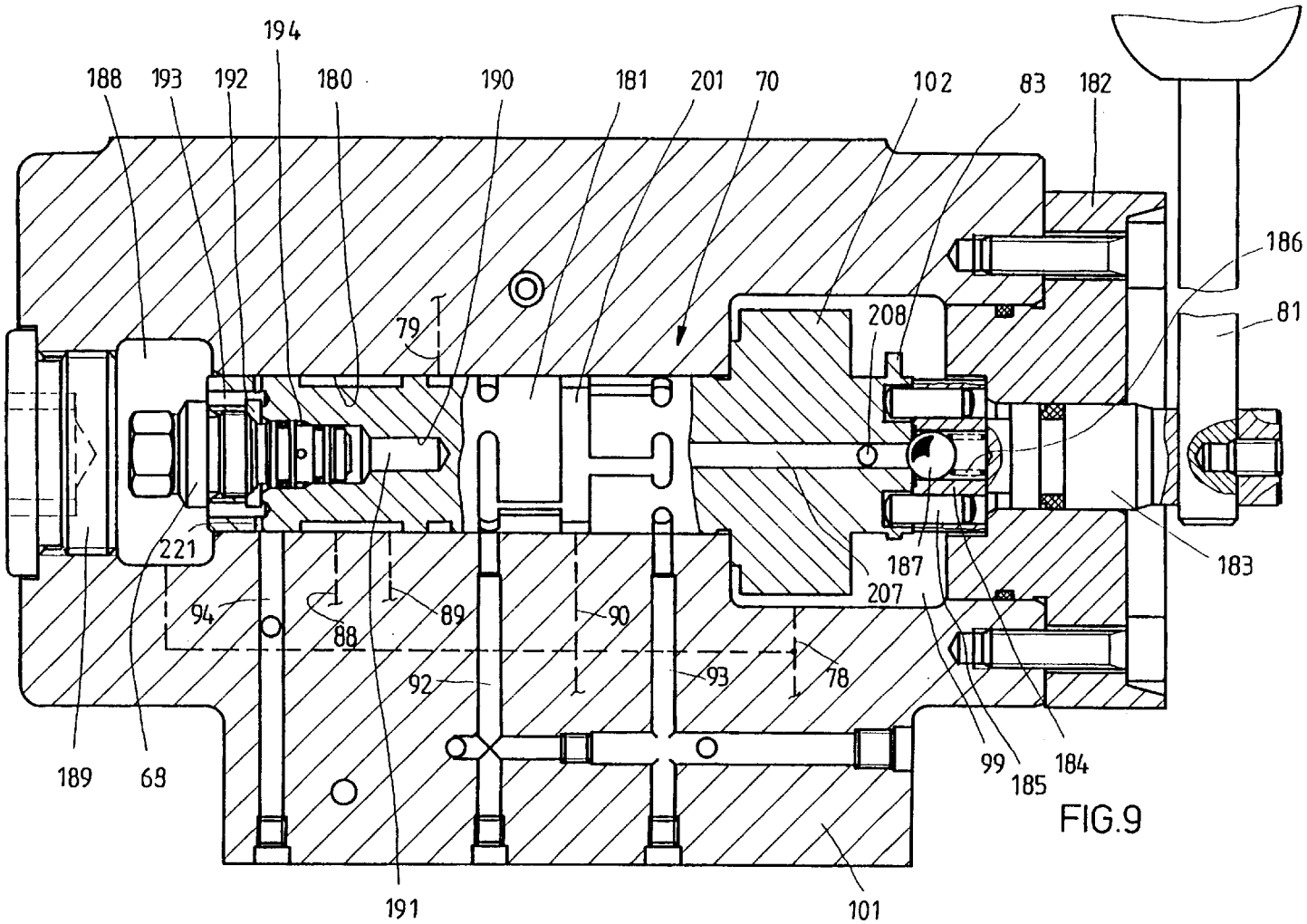
FIG. 9 shows a section along the line IX—IX from FIG. 2

FIG. 9 reveals that the housing 101 has a valve bore 180, in which the movable control element of the directional control valve 70, formed as a rotary slide 181, is located and into which the various lines or line sections which lead to the directional control valve according to FIG. 1 and which are formed as bores in the housing 101 open, as will be described further using FIG. 10. At its one end, the valve bore 180 widens to form the hollow chamber 99, in which the cam disk 102 and the control disk 83 are located. The cam disk 102 and control disk 83 are produced in one piece with the rotary slide 181. The hollow chamber 99 is closed off to the outside by a housing cover 182, in which, centrally and aligned with the axis of the rotary slide 181, the shaft 183 is rotatably mounted, projects beyond the cover 182 and on which the control lever 81 is fixed to the projecting section. The shaft ends within the housing 101 in a stop collar 184, which strikes a step in the cover 182 and prevents the shaft 183 becoming detached from the housing 101. Shaft 183 and rotary slide 181 are coupled to each other in a rotationally secure manner by two pins 185, each of which engages axially in a hole in the rotary slide and the shaft. In a central blind hole in the shaft 183, which is open toward the rotary slide 181, there is accommodated a compression spring 186, which is supported on the base of the blind hole and, via a ball 187, on the rotary slide 181 and urges the shaft 183 and rotary slide 181 apart axially, so that at one end the shaft 183 bears on the cover 182 and the rotary slide 181 via the cam disk 102 on the housing 101, and the two parts assume largely fixed axial positions.

Opposite the hollow chamber 99, the valve bore 180 opens into an end chamber 188, which has an enlarged radius and is closed off to the outside by a closure screw 189. The hollow chamber 99 and the chamber 188, as indicated by the dashed line provided with the reference number 78 from FIG. 1, are connected to each other and to the leakage oil line 19.

From the side facing the closure screw 189, a stepped blind bore 190, into which the pressure reducing valve 68 is inserted, is introduced into the rotary slide 181. Axially upstream of the pressure reducing valve 68, the blind bore 190 forms an axial control connection 191 of the pressure reducing valve 68, into which the latter regulates a constant pilot control pressure of 40 bar. An annular chamber 192 between the pressure reducing valve 68 and the rotary slide 181, said chamber being connected via two axial holes 193 to the chamber 188, forms the outlet connection of the pressure reducing valve 68. A second annular chamber 194 is the feed connection of the pressure reducing valve.

Figure 10:
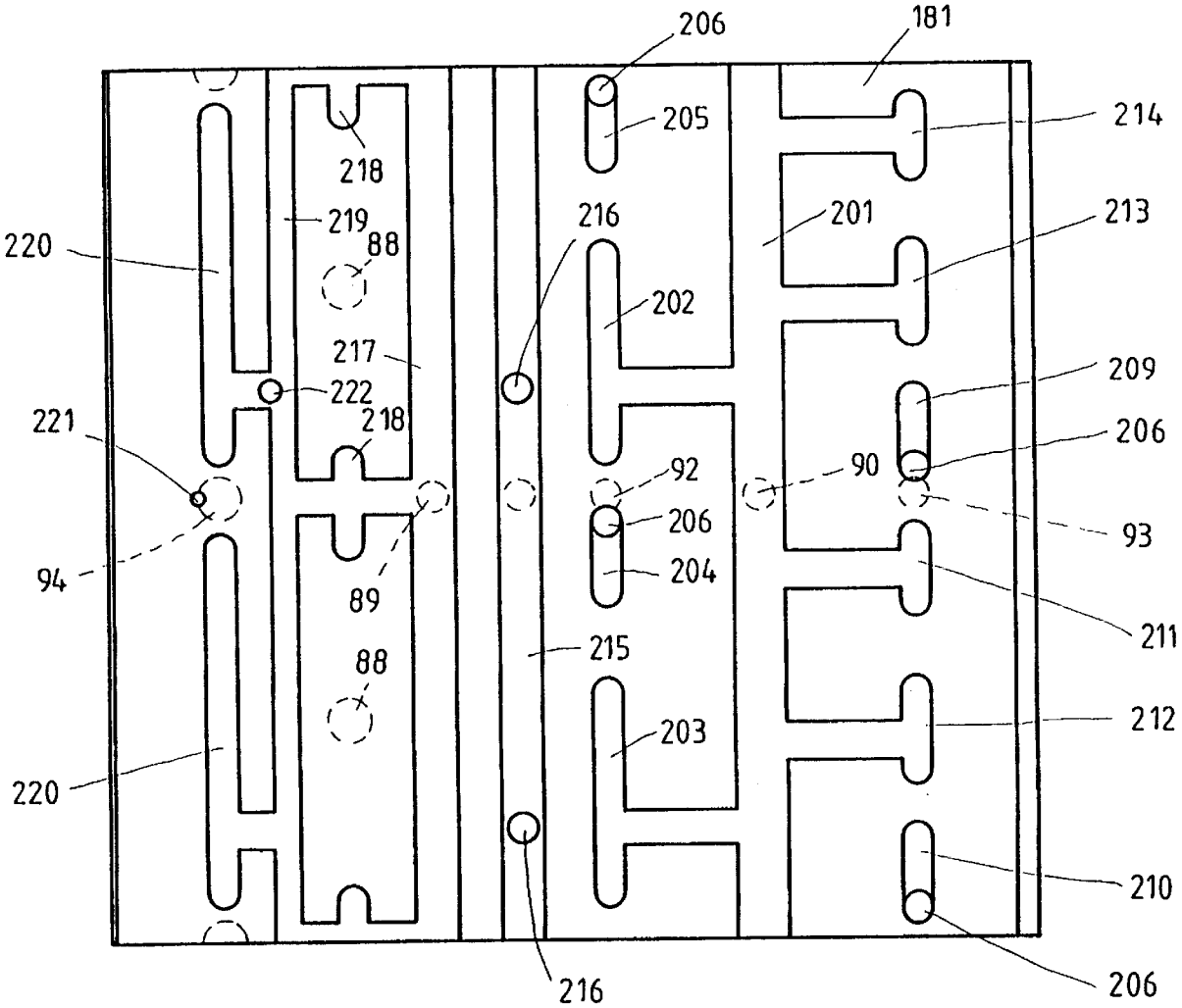
FIG. 10 shows the unrolled groove pattern of the rotary slide of the directional control valve, via which the control output of the adjustable pressure valve can be connected to one control output, to the other or to both control outputs.

In the developed representation of the rotary slide 181 according to FIG. 10, dashed lines represent the openings of various holes in the housing 101, which are shown partially three-dimensionally in FIG. 9 and partially by dashed lines and which represent the various connections 88 to 94 of the directional control valve 70. The connection 90 opens into the valve bore 180 at a point at which an annular groove 201 runs around the rotary slide 181. In a line, axially on one side of the connection 90 and at a distance from the latter, the connection 92 opens into the valve bore 180 and, on the other side, the connection 93 opens into the valve bore 180. Axially at the level of the connection 92 there are in the rotary slide 181 two equally long finite grooves 202 and 203, which are connected to the annular groove 201 via axial grooves. Between the two grooves 202 and 203 there are shorter grooves 204 and 205, which in each case have a fluidic connection via a radial hole 206 to a central axial bore 207, and via a further radial hole 208 in the rotary slide 181 to the hollow chamber 99 and therefore to the leakage line.

Point-symmetrical in relation to the grooves 204 and 205 with respect to the connection 90, axially at the level of the connection 93, there are two grooves 209 and 210, which in turn are connected via radial holes 206 to the axial bore 207 in the rotary slide 181. Between the two grooves 209 and 210 there are in each case two grooves 211 and 212 and, respectively, 213 and 214 which, like the grooves 202 and 203, are connected to the annular groove 201 via axial grooves. Only the annular groove 201 and the grooves 202, 204, 209, 211 and 213 are important for the directional control functions of the valve 70. The other grooves are used for radial pressure equalization on the rotary slide 181.

In FIG. 10, the rotary slide 181 is shown in a position which it assumes in the neutral position of the control lever 81. It can be seen that the grooves 204 and 209 cover the connections 92 and 93, so that these two connections are relieved of pressure. If, then, for the hoisting operating mode of the winch, the rotary slide is moved downward in the view according to FIG. 10, then the connection 92 will be isolated from the groove 204 and, after a short distance, comes to overlap the groove 202. The connection 92 is therefore then connected to the control output of the pressure reducing valve 69. The connection 93 initially remains overlapping the groove 209 and is therefore relieved of pressure. This configuration is maintained as far as the end of the hoisting angle range 86 from FIG. 1. The connection 93 then passes out of the range of the groove 209 and comes to overlap the groove 213. The same pilot control pressure is then present on said connection 93 as on the connection 92.

When the control lever is pivoted in the easing direction, the connection 92 continues to overlap the groove 204, while the connection 93 comes to overlap the groove 211.

In addition to the grooves 202 to 205, the rotary slide 181 also has a circumferential groove 215 from which, radial holes 216 start and open into the blind bore 191 upstream of the pressure reducing valve 68 inserted into the rotary slide 181, that is to say are connected to the control output of the pressure reducing valve 68. The groove 215 and the radial holes 216 are therefore located in the duct 79 according to FIG. 1, via which a largely constant supply control pressure is present on the feed connection of the pressure reducing valve 69.

In the region of the connection 89, a groove 217 runs around the rotary slide 181 and, via axial grooves, is connected to two mutually diametrically opposite short grooves 218. If the control lever is pivoted as far as the mooring angle range, the grooves 218 come to overlap with the connections 88, so that pressure medium can flow via the bypass line 66 from FIG. 1. The grooves 218 and therefore the groove 217 are connected via a further annular groove 219 to two mutually diametrically opposite grooves 220 which the connection 94 comes to overlap when the control lever is pivoted out of the neutral position, so that the annular chamber 15 of the cylinder 14 from FIG. 1 can have system pressure applied to it. In the neutral position of the control lever 81, the connection 94 is connected to the axial bores 193 via a small radial hole 221 in the rotary slide 181, and is therefore relieved to the tank. Via the radial hole 222 which is open toward the annular groove 219, the annular chamber 194, that is to say the pressure inlet to the pressure reducing valve 68, is connected to the annular groove 217 and therefore to the bypass line 66.

We claim:

1. A hydraulic pilot control system having two control outputs (96, 97) to which a control pressure is appliable and having a hydraulic pilot controller (69, 70), which has a handle (81) pivotable from a neutral position in a first direction to apply a variable control pressure to a first of the control outputs (96) and in a second direction to apply a variable control pressure to a second of the control outputs (97), and wherein a pressure valve (69) of the pilot controller is displaced from the neutral position by deflection of the handle (81) to generate the variable control pressure at a control output (80) of the pressure valve (69), during a pivoting of the handle (81) in the first direction and during a pivoting of the handle (81) in the second direction, the pressure valve (69) of the pilot controller is adjusted by movement of the handle, and a directional control valve (70) of the pilot controller depends on a pivoting direction of the handle (81) from a rest position to change into a first switching position which connects the control output (80) of the pressure valve (69) to the first control output (96), or to change into a second switching position which connects the control output (80) of the pressure valve (69) to the second control output (97).

2. The hydraulic pilot control system as claimed in claim 1, wherein relationship between displacement of the displaceable pressure valve (69) when the handle (81) is pivoted in the second direction from the neutral position is the same as when the handle (81) is pivoted in the first direction from the neutral position.

3. The hydraulic pilot control system as claimed in claim 1, wherein the adjustable pressure valve (69) is a three-way pressure reducing valve.

4. A hydraulic pilot control system having two control outputs (96, 97) to which a control pressure is appliable and having a hydraulic pilot controller (69, 70), which has a handle (81) pivotable from a neutral position in a first direction to apply a variable control pressure to a first of the control outputs (96) and in a second direction to apply a variable control pressure to a second of the control outputs (97), and a pressure valve (69) which is displaced from the neutral position by the deflection of the handle (81) and generates the variable control pressure at a control output (80) of the pressure valve (69), wherein during a pivoting of the handle (81) in the first direction and during a pivoting of the handle (81) in the second direction, the pressure valve (69) is adjustable by movement of the handle, a directional control valve (70) which, depending on pivoting direction of the handle (81) from a rest position, which it assumes in the neutral position of the handle (81), is changable over into a first switching position, in which it connects the control output (80) of the pressure valve (69) to the first control output (96), or into a second switching position, in which it connects the control output (80) of the pressure valve (69) to the second control output (97); and wherein, in the rest position of the directional control valve (70), the two control outputs (96, 97) are relievable of pressure via a tank connection (91) of the directional control valve (70), circumventing the pressure valve (69).

5. A hydraulic pilot control system having two control outputs (96, 97) to which a control pressure is appliable and having a hydraulic pilot controller (69, 70), which has a handle (81) pivotable from a neutral position in a first direction to apply a variable control pressure to a first of the control outputs (96) and in a second direction to apply a variable control pressure to a second of the control outputs (97), and a pressure valve (69) which is displaced from the neutral position by the deflection of the handle (81) and generates the variable control pressure at a control output (80) of the pressure valve (69), wherein during a pivoting of the handle (81) in the first direction and during a pivoting of the handle (81) in the second direction, the pressure valve (69) is adjustable by movement of the handle, a directional control valve (70) which, depending on pivoting direction of the handle (81) from a rest position, which it assumes in the neutral position of the handle (81), is changable over into a first switching position, in which it connects the control output (80) of the pressure valve (69) to the first control output (96), or into a second switching position, in which it connects the control output (80) of the pressure valve (69) to the second control output (97); and wherein the directional control valve (70) has, as a movable control element, a rotary slide (181), whose axis is aligned with an axis of rotation of the handle (81) and which is rotatable via the handle (81) in a valve bore (180) in a valve housing (101).

6. The hydraulic pilot control system as claimed in claim 5, wherein the rotary slide (181) has an axial stop (102) with which it is urged by a spring (186) against a stop on the valve housing (101).

7. The hydraulic pilot control system as claimed in claim 6, wherein the handle (81) is fixed to a shaft (183) which is rotatably mounted relative to the valve housing, and has an axial stop (184) which acts in the direction out of the valve housing (101), wherein the rotary slide (181), as a separate part, is rotationally securely coupled to the shaft (183), and wherein between the shaft (183) and the rotary slide (181) there is arranged said spring (186) that urges the shaft and rotary slide axially apart.

8. The hydraulic pilot control system as claimed in claim 6, wherein connected in one piece to the rotary slide (181) is a cam disk (102), on which a pressure piece (145) belonging to a restoring device (103) for the handle (81) bears under force of a restoring spring (149), said cam disk (102) projecting radially beyond the rotary slide (181) and forming the axial stop of the rotary slide (181).

9. A hydraulic pilot control system having two control outputs (96, 97) to which a control pressure is appliable and having a hydraulic pilot controller (69, 70), which has a handle (81) pivotable from a neutral position in a first direction to apply a variable control pressure to a first of the control outputs (96) and in a second direction to apply a variable control pressure to a second of the control outputs (97), and a pressure valve (69) which is displaced from the neutral position by the deflection of the handle (81) and generates the variable control pressure at a control output (80) of the pressure valve (69), wherein during a pivoting of the handle (81) in the first direction and during a pivoting of the handle (81) in the second direction, the pressure valve (69) is adjustable by movement of the handle, a directional control valve (70) which, depending on pivoting direction of the handle (81) from a rest position, which it assumes in the neutral position of the handle (81), is changable over into a first switching position, in which it connects the control output (80) of the pressure valve (69) to the first control output (96), or into a second switching position, in which it connects the control output (80) of the pressure valve (69) to the second control output (97); and wherein a control element of the directional control valve (70), formed as a slide (181), in an axial bore (190) introduced into it from its one end, accommodates a permanently set pressure reducing valve (68) for an internal control pressure supply.

10. The hydraulic pilot control system as claimed in claim 9, wherein the pressure reducing valve (68) has an axial control connection (191) which is oriented into the axial bore (190) and is connected to a housing duct (79) via at least one radial hole (216) in the slide (181) opening into the axial bore (190), a radial outlet connection (192), which is connected to a chamber (188) in front of the end of the slide (181) via at least one axial bore (193) in the slide (181), and a radial feed connection (194), which is located further in than the outlet connection (192) in the axial bore (190) and which in turn is connected to a housing duct via at least one radial hole (221) in the slide (181) opening into the axial bore.

11. A hydraulic pilot control system having two control outputs (96, 97) to which a control pressure is appliable and having a hydraulic pilot controller (69, 70), which has a handle (81) pivotable from a neutral position in a first direction to apply a variable control pressure to a first of the control outputs (96) and in a second direction to apply a variable control pressure to a second of the control outputs (97), and a pressure valve (69) which is displaced from the neutral position by the deflection of the handle (81) and generates the variable control pressure at a control output (80) of the pressure valve (69), wherein during a pivoting of the handle (81) in the first direction and during a pivoting of the handle (81) in the second direction, the pressure valve (69) is adjustable by movement of the handle, a directional control valve (70) which, depending on pivoting direction of the handle (81) from a rest position, which it assumes in the neutral position of the handle (81), is changable over into a first switching position, in which it connects the control output (80) of the pressure valve (69) to the first control output (96), or into a second switching position, in which it connects the control output (80) of the pressure valve (69) to the second control output (97); and wherein the adjustable pressure valve (69) has a plunger (84) which is displaceable in direction of its axis, wherein the axis of the plunger (84) passes substantially perpendicularly through a pivot axis of the handle (81), and wherein the plunger (84) is displaceable, counter to force of a spring (133, 134) of the pressure valve (69), by a control cam (105) located on the circumference of a control disk (83) that is rotatable by the handle (81).

12. A hydraulic pilot control system having two control outputs (96, 97) to which a control pressure is appliable and having a hydraulic pilot controller (69, 70), which has a handle (81) pivotable from a neutral position in a first direction to apply a variable control pressure to a first of the control outputs (96) and in a second direction to apply a variable control pressure to a second of the control outputs (97), and a pressure valve (69) which is displaced from the neutral position by the deflection of the handle (81) and generates the variable control pressure at a control output (80) of the pressure valve (69), wherein during a pivoting of the handle (81) in the first direction and during a pivoting of the handle (81) in the second direction, the pressure valve (69) is adjustable by movement of the handle, a directional control valve (70) which, depending on pivoting direction of the handle (81) from a rest position, which it assumes in the neutral position of the handle (81), is changable over into a first switching position, in which it connects the control output (80) of the pressure valve (69) to the first control output (96), or into a second switching position, in which it connects the control output (80) of the pressure valve (69) to the second control output (97); and wherein the adjustable pressure valve (69), after its components are mounted in a housing (101), is adjustable from outside such that at a specific pivoting angle of the handle (81) a specific pilot control pressure is present on the control output (80) of the pressure valve (69).

13. The hydraulic pilot control system as claimed in claim 12, wherein the adjustable pressure valve has a valve housing, an axially guided plunger that is displaceable via the handle, a movable control element, which interacts with at least one control edge fixed to the housing, a control spring, which bears with one end on the movable control element and whose other end is drivable along in event of a displacement of the plunger, an adjustable stop which is fixed to the housing and, with respect to the control element, is located opposite the plunger, and an adjustment spring, which is arranged between the stop and the control element.

14. The hydraulic pilot control system as claimed in claim 12, wherein the adjustable pressure valve (69) has valve housing (101), an axially guided plunger (84) that is displaceable via the handle (81), a movable control element (125), which interacts with at least one control edge fixed to the housing, a control spring (134), which bears with one end on the movable control element (125) and whose other end is drivable along in event of a displacement of the plunger (84), and a control cartridge (108) introduced into the valve housing (101), on which the at least one control edge fixed to the housing is located and whose axial position is adjustable from outside.

15. The hydraulic pilot control system as claimed in claim 14, wherein the plunger (84) is guided in a guide sleeve (118) and wherein the control cartridge (108) is extended beyond the at least one control edge and accommodates the guide sleeve (118) in a captive manner.

* * * * *